US007182161B2

(12) United States Patent
Swietlik

(10) Patent No.: US 7,182,161 B2
(45) Date of Patent: Feb. 27, 2007

(54) DRILL STRING TOOL WITH BEARING SLEEVE

(75) Inventor: George Swietlik, Lowestoft (GB)

(73) Assignee: Pilot Drilling Control Limited, Lowestof (GB)

( * ) Notice: Subject to any disclaimer, the term of this patent is extended or adjusted under 35 U.S.C. 154(b) by 175 days.

(21) Appl. No.: 10/888,112

(22) Filed: Jul. 9, 2004

(65) Prior Publication Data

US 2005/0034900 A1 Feb. 17, 2005

(51) Int. Cl.
*E21B 17/10* (2006.01)

(52) U.S. Cl. ..... 175/323; 175/325.5

(58) Field of Classification Search ..... 175/323, 175/325.5, 325.6, 325.7; 166/241.6
See application file for complete search history.

(56) References Cited

U.S. PATENT DOCUMENTS 1,794,278 A * 2/1931 Carney ..... 175/325.5
3,360,846 A * 1/1968 Schellstede et al. ..... 29/447
3,971,450 A * 7/1976 Fox ..... 175/107
4,445,727 A * 5/1984 Funk ..... 175/325.5
5,542,454 A * 8/1996 Carlson et al. ..... 138/110
6,352,107 B1 3/2002 Bennett et al.
2001/0032722 A1 10/2001 Eaton

FOREIGN PATENT DOCUMENTS

WO WO 96/03568 2/1996

* cited by examiner

*Primary Examiner*—William P. Neuder
(74) *Attorney, Agent, or Firm*—Seyfarth Shaw LLP

(57) ABSTRACT

A drill string tool such as a drill string stabilizer (1) comprises a circumferentially continuous bearing sleeve (6) having an outside diameter which is equal to or greater than the outside diameter of a radially outermost part of the drill string tool.

12 Claims, 2 Drawing Sheets

DRILL STRING TOOL WITH BEARING SLEEVE

This invention relates to a drill string tool, such as a stabiliser, with a circumferentially continuous bearing sleeve which provides a continuous contact surface between the drill string tool and a bore hole.

BACKGROUND

In conventional oil drilling operations, it is known for bore holes to extend for many kilometers and for the drill bit to be steered, so that the direction of the bore hole may change along its length. The length of such bore holes and the deviation of the bore hole results in enormous loads on the drill string as it rotates. To reduce drag in the bore hole, the drill string is of a considerably smaller diameter than the bore hole and the bore hole is only contacted along its length by the drill bit and by various drill string tools, such as drill string stabilisers which stabilise the drill string relative to the bore hole, and cutting bed impellers which lift cuttings from the lower side of the bore hole to the upper side of the bore hole where they can be raised to the surface under the action of a continuous flow of drilling mud. In certain circumstances, such as where successive down hole tools are working in rock strata of different hardness, the down hole tool working in the weaker strata may become unstable and may gouge the sides of the bore hole, increasing the amount of material which must be carried to the surface and reducing the local stability of the drill string. The present invention has been created to alleviate this problem.

STATEMENT OF INVENTION

A drill string tool comprising a circumferentially continuous bearing sleeve having an outside diameter which is equal to or greater than the outside diameter of a radially outer most part of the drill string tool.

Preferably, the bearing sleeve is integrally formed with the drill string tool. For example, the bearing sleeve may be machined at the same time as the drill string tool.

Alternatively, the bearing sleeve may be a separate component which is fixed to the drill string tool. Preferably, the bearing sleeve is heat shrunk onto the drill string tool.

Preferably means are provided to locate the bearing sleeve on the drill string tool. These means may comprise corporating formations formed in or on the bearing sleeve of the drill string tool. Most preferably, at least part of the bearing sleeve is located on the drill string tool in a circumferential recess or groove. The said groove may be discontinuous and may be formed in one or more blades of the drill string tool.

Preferably, the bearing sleeve is locally narrowed adjacent the said blades, the narrowed portion of the bearing sleeve being received within the groove.

Although the invention works well with only a single sleeve, a plurality of sleeves maybe provided on the same drill string tool.

Preferably, the drill string tool is a drill string stabiliser.

Preferably replaceable wear elements are provided on the radially outer surface of the bearing sleeve.

BRIEF DESCRIPTION OF THE DRAWINGS

For a better understanding of the present invention and to show how it may be carried into effect, reference will now be made, by way of example, to the accompanying drawings in which.

DETAILED DESCRIPTION OF PREFERRED EMBODIMENTS

Figure 1:
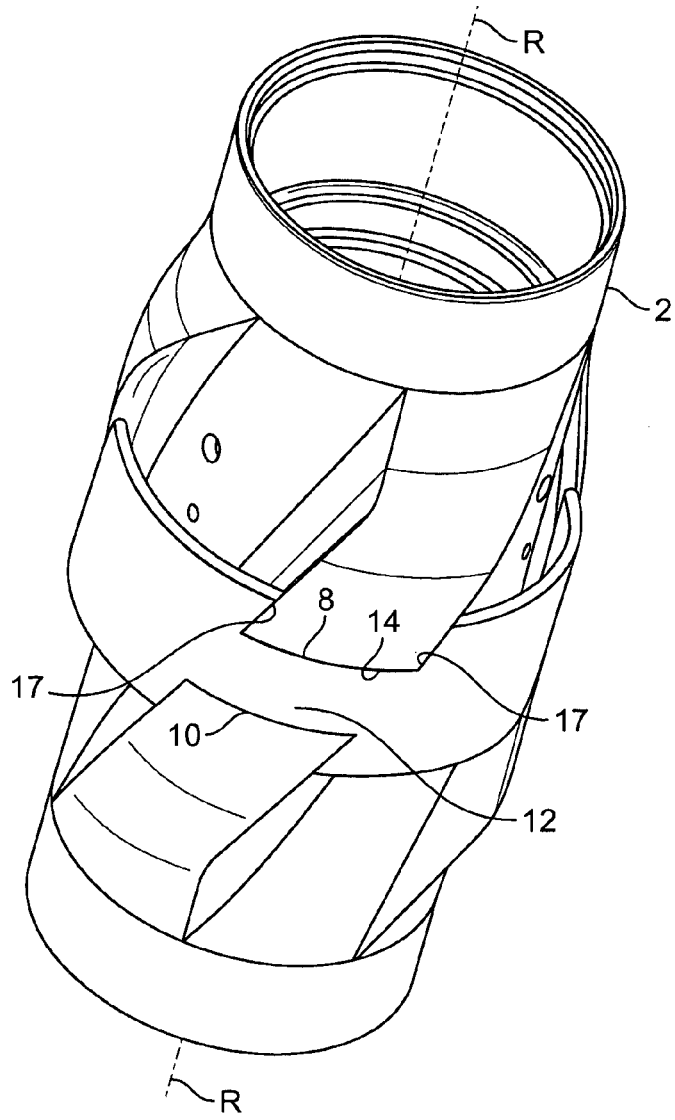
FIG. 1 is a perspective view of a first embodiment of drill string stabiliser having a bearing sleeve in accordance with the present invention.
Figure 2:
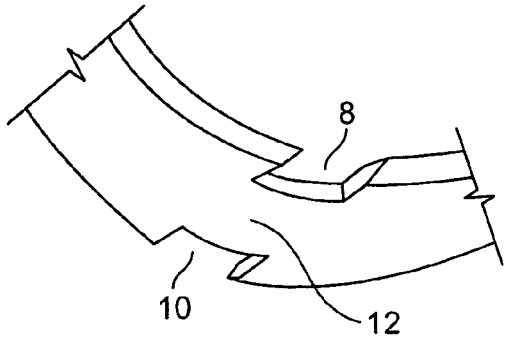
FIG. 2 is a partial enlarged view of the bearing sleeve in the region adjacent a blade of the drill string stabiliser.

FIGS. 1 and 2 show a drill string tool in a form of a drill string stabiliser 1 having a cylindrical main body 2 from which project a plurality of blades 4. The main body 2 and blades 4 are of conventional form, the blades 4 being offset relative to the rotation axis R of the drill string stabiliser.

A circumferentially continuous bearing sleeve 6 extends around the main body 2 and lies in a plane substantially perpendicular to the axis of rotation R of the drill string stabiliser 1. The bearing sleeve 6 is provided in the vicinity of each blade 4 with a pair of cut outs 8, 10 which are separated by a narrowed portion 12 of the bearing sleeve 6. The narrowed portion 12 of the bearing sleeve 6 is accommodated within recesses 14 formed across each of the blades 4.

In the illustrated embodiment the side walls 16 of the blades 4 are offset so that the root of each blade 4 is wider than its tip. In order to conform to the taper of the blades, the side walls 17 of each recess also taper, so that the radially inner end of each cut-out 8,10 is wider that the radially outer end.

In order to manufacture a drill string stabiliser 1, in accordance with a first embodiment of the present invention the main body 2 and blades 4 are formed separately from the bearing sleeve 6. The bearing sleeve 6 is then heated, so that it fits over the blades 4 and is located such that its narrowed portions 12 are located directly over the recesses 14 in each blade. As the bearing sleeve 6 cools, it contracts so that the narrowed portions 12 are drawn into the recesses 14 in the blades 4. This manufacturing technique gives enormous strength to the drill string stabiliser 1 and ensures that the bearing sleeve 6 cannot rotate, or move axially relative to the main body 2 of the drill string stabiliser 1. It will be apparent that movement of the bearing sleeve 6 relative to the main body 2 would cause rapid wear and must be prevented.

Figure 3:
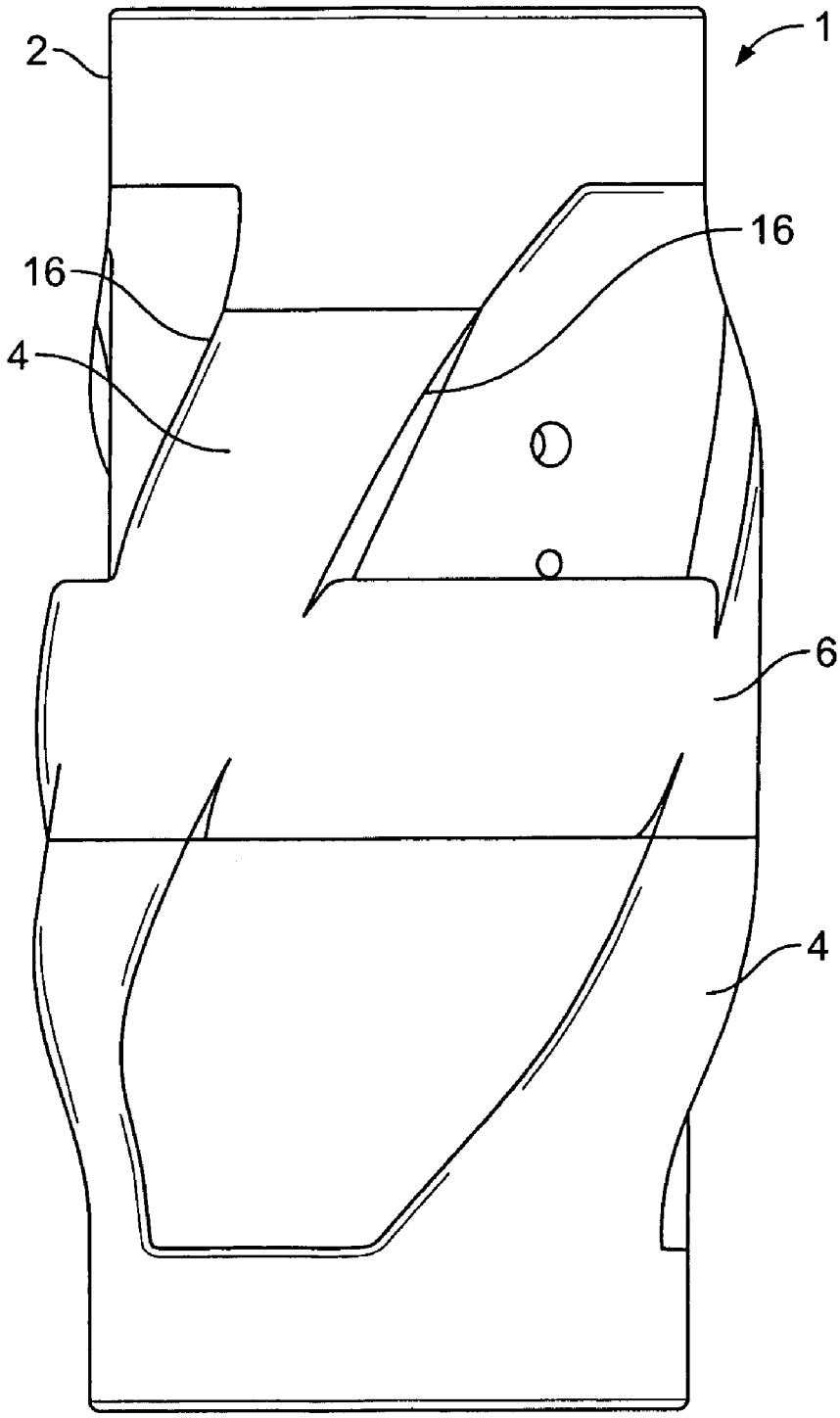
FIG. 3 is a plan view of a drill string stabiliser having an integral bearing sleeve.

FIG. 3 illustrates an alternative embodiment in which the bearing sleeve 6 is machined integrally with the main body 2 and blades 4 of the drill string stabiliser 1.

The invention claimed is:

1. A drill string tool comprising a plurality of blades projecting outwardly from the drill string tool and a circumferentially continuous bearing sleeve which passes around the blades and has an outside diameter which is equal to or greater than the outside diameter of the blades.

2. A drill string tool as claimed in claim 1, in which the bearing sleeve is integrally formed with the drill string tool.

3. A drill string tool as claimed in claim 1, in which the bearing sleeve is a separate component which is fixed to the drill string tool.

4. A drill string tool as claimed in claim 3, in which the bearing sleeve is heat shrunk on to the drill string tool.

5. A drill string tool as claimed in claim 3, in which the bearing sleeve is located on the drill string tool by means of cooperating formations formed in or on the bearing sleeve and the drill string tool.

6. A drill string tool as claimed in claim 5, in which the cooperating formations comprise a circumferential recess or groove.

7. A drill string tool as claimed in claim 6, in which a plurality of recesses or grooves are formed on the drill string tool.

8. A drill string tool as claimed in claim 1, in which the bearing sleeve is locally narrowed adjacent to each blade, the narrow portion of the bearing sleeve being received within a recess or groove.

9. A drill string tool as claimed in claim 1, in which there are a plurality of sleeves on the drill string tool.

10. A drill string tool as claimed in claim 1, comprising a drill string stabilizer.

11. A drill string tool as claimed in claim 1, in which replaceable wear elements are provided on the radially outer surface of the bearing sleeve.

12. A drill string tool comprising a circumferentially continuous bearing sleeve having an outside diameter which is equal to or greater than the outside diameter of the radially outermost part of the drill string tool;

at least one blade which projects from the drill string tool, wherein said bearing sleeve is locally narrowed adjacent said blade, the narrow portion of the bearing sleeve being received within a recess or groove.

* * * * *

UNITED STATES PATENT AND TRADEMARK OFFICE

CERTIFICATE OF CORRECTION

PATENT NO. : 7,182,161 B2
APPLICATION NO. : 10/888112
DATED : February 27, 2007
INVENTOR(S) : George Swietlik It is certified that error appears in the above-identified patent and that said Letters Patent is hereby corrected as shown below:

TITLE PAGE,
Item [30] Foreign Application Priority Data should be added to the cover page

July 11, 2003 (GB) 0316326.8

Signed and Sealed this

First Day of May, 2007

JON W. DUDAS
*Director of the United States Patent and Trademark Office*